US011362406B2

(12) United States Patent
Nakahori et al.

(10) Patent No.: US 11,362,406 B2
(45) Date of Patent: Jun. 14, 2022

(54) DIELECTRIC WAVEGUIDE FILTER

(71) Applicant: Murata Manufacturing Co., Ltd., Nagaokakyo (JP)

(72) Inventors: Manabu Nakahori, Nagaokakyo (JP); Hiroshi Kojima, Nagaokakyo (JP); Masayuki Kikuda, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 17/110,386

(22) Filed: Dec. 3, 2020

(65) Prior Publication Data

US 2021/0091441 A1 Mar. 25, 2021

Related U.S. Application Data

(63) Continuation of application No. PCT/JP2019/020291, filed on May 22, 2019.

(30) Foreign Application Priority Data

Jul. 2, 2018 (JP) ..... JP2018-125911

(51) Int. Cl.
*H01P 3/16* (2006.01)
*H01P 1/20* (2006.01)
*H01P 7/10* (2006.01)

(52) U.S. Cl.
CPC ..... *H01P 1/2002* (2013.01); *H01P 3/16* (2013.01); *H01P 7/10* (2013.01)

(58) Field of Classification Search
CPC ..... H01P 1/2002; H01P 1/20; H01P 1/201; H01P 1/207; H01P 1/208; H01P 1/2084; H01P 1/2086; H01P 1/2088; H01P 3/16; H01P 3/122; H01P 3/112; H01P 3/12; H01P 3/121; H01P 7/10; H01P 7/105
See application file for complete search history.

(56) References Cited

U.S. PATENT DOCUMENTS 9,088,062 B2 * 7/2015 Ito ..... H01P 1/2084
2009/0231064 A1 9/2009 Bates et al.
2012/0229233 A1 9/2012 Ito
(Continued)

FOREIGN PATENT DOCUMENTS

JP 50-104547 A 8/1975
JP 63-24704 A 2/1988
(Continued)

OTHER PUBLICATIONS

Official Communication issued in International Patent Application No. PCT/JP2019/020291, dated Jun. 18, 2019.

*Primary Examiner* — Stephen E. Jones
(74) *Attorney, Agent, or Firm* — Keating & Bennett, LLP

(57) ABSTRACT

A dielectric waveguide filter includes at least four dielectric waveguide resonators arranged along a main coupling path for signal propagation, and main coupling portions each of which is provided between the dielectric waveguide resonators that are adjacent to each other along the main coupling path among the at least four dielectric waveguide resonators. The main coupling portions include an inductive coupling portion and a capacitive coupling portion, and the inductive coupling portion and the capacitive coupling portion are alternately and repeatedly arranged along the main coupling path.

20 Claims, 16 Drawing Sheets

(56) References Cited

U.S. PATENT DOCUMENTS

| | | | |
|---|---|---|---|
| 2012/0286901 | A1 | 11/2012 | Vangala |
| 2015/0380792 | A1 | 12/2015 | Rogozine et al. |

FOREIGN PATENT DOCUMENTS

| | | | |
|---|---|---|---|
| JP | 2012-191474 | A | 10/2012 |
| JP | 2014-521278 | A | 8/2014 |
| WO | 2016/191116 | A1 | 12/2016 |
| WO | 2018/012294 | A1 | 1/2018 |
| WO | 2018/139321 | A1 | 8/2018 |

* cited by examiner

DIELECTRIC WAVEGUIDE FILTER

CROSS REFERENCE TO RELATED APPLICATIONS

This application claims the benefit of priority to Japanese Patent Application No. 2018-125911 filed on Jul. 2, 2018 and is a Continuation Application of PCT Application No. PCT/JP2019/020291 filed on May 22, 2019. The entire contents of each application are hereby incorporated herein by reference.

BACKGROUND OF THE INVENTION

1. Field of the Invention

The present invention relates to a dielectric waveguide filter that includes a plurality of dielectric waveguide resonators.

2. Description of the Related Art

International Publication No. 2018/012294, for example, discloses a dielectric waveguide filter that includes a plurality of dielectric waveguide resonators. In the dielectric waveguide filter described in International Publication No. 2018/012294, a coupling portion is formed between resonators so as to couple adjacent dielectric waveguide resonators.

In a dielectric waveguide filter, in which a plurality of dielectric waveguide resonators are arranged and adjacent dielectric waveguide resonators are coupled with each other, as the one described in International Publication No. 2018/012294, adjacent dielectric waveguide resonators are coupled with each other along a main coupling path and a sub coupling path can also be formed for coupling a plurality of dielectric waveguide resonators in a jumped manner following the main coupling path.

Inductive coupling has been conventionally used for coupling of resonators that forms the main coupling path. However, if the main coupling path is composed only of inductive coupling, gentle attenuation characteristics are exhibited from a pass band to a higher band. Therefore, when steep attenuation characteristics are required from a pass band to a higher band, the number of stages of resonators to be coupled needs to be increased, resulting in an increase of insertion loss in the pass band.

The main coupling path may be composed of capacitive coupling, but the capacitive coupling causes a spurious response in a lower band than a pass band in this case.

SUMMARY OF THE INVENTION

Preferred embodiments of the present invention provide dielectric waveguide filters that each have steep attenuation characteristics from a pass band to a higher band with a smaller number of stages of resonators and each reduce or prevent a spurious response occurring in a lower band than the pass band.

A dielectric waveguide filter according to a preferred embodiment of the present invention includes at least four dielectric waveguide resonators arranged along a main coupling path for signal propagation, and a plurality of main coupling portions each of which is provided between the dielectric waveguide resonators that are adjacent to each other along the main coupling path among the at least four dielectric waveguide resonators. The plurality of main coupling portions include an inductive coupling portion and a capacitive coupling portion that are alternately and repeatedly arranged along the main coupling path.

According to the dielectric waveguide filter having the above structure, the main coupling path includes the capacitive coupling portion, so that steep attenuation characteristics are able to be obtained from a pass band to a higher band with the smaller number of stages of resonators. Further, since dielectric waveguide resonators which are capacitively coupled with each other do not continue on two or more stages along the main coupling path, that is, since a capacitive coupling portion is interposed between inductive coupling portions along the main coupling path, excitation in a low order mode caused by capacitive coupling does not predominantly appear, thus being reduced or prevented. Accordingly, a spurious response occurring in a lower band than a pass band is reduced or prevented.

According to preferred embodiments of the present invention, dielectric waveguide filters are able to be obtained that each have steep attenuation characteristics from a pass band to a higher band with the smaller number of stages of resonators and that each reduce or prevent a spurious response occurring in a lower band than the pass band.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1A:
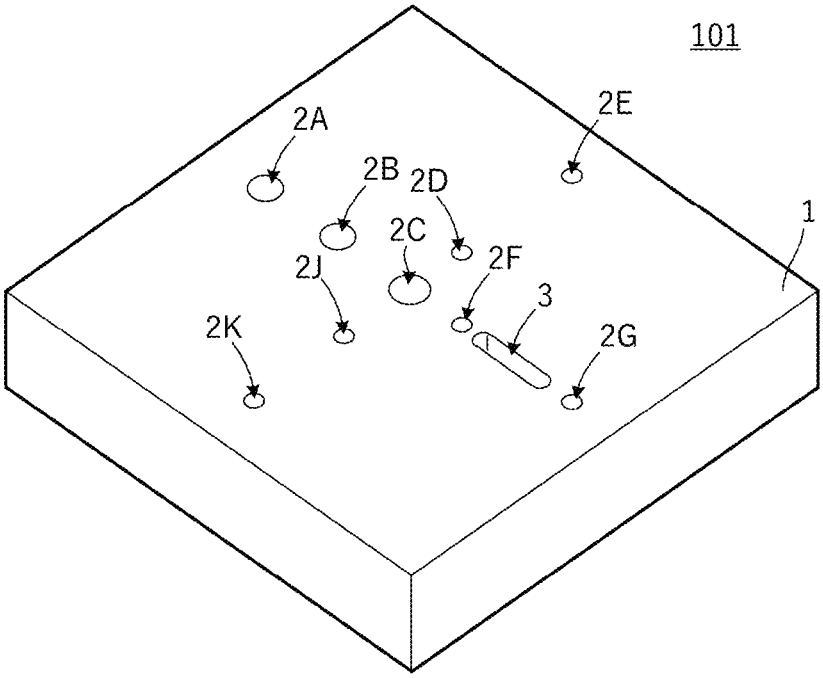
FIG. 1A is an external perspective view of a dielectric waveguide filter 101 according to a first preferred embodiment of the present invention and FIG. 1B is a transparent perspective view illustrating an internal structure of the dielectric waveguide filter 101.

Preferred embodiments of the present invention will be described below by referring to examples with reference to the accompanying drawings. The same or corresponding portions among the drawings are denoted by the same reference characters. In consideration of easiness in description of the gist and easiness in understanding, the preferred embodiments will be separately described for the purpose of convenience in description. However, structures described in different preferred embodiments may be partially exchanged or combined. Description of matters common to a first preferred embodiment will be omitted and only different points will be described in and after a second preferred embodiment. Especially, the same advantageous effects of the same or similar structures will not be described for each preferred embodiment.

First Preferred Embodiment

Figure 1B:
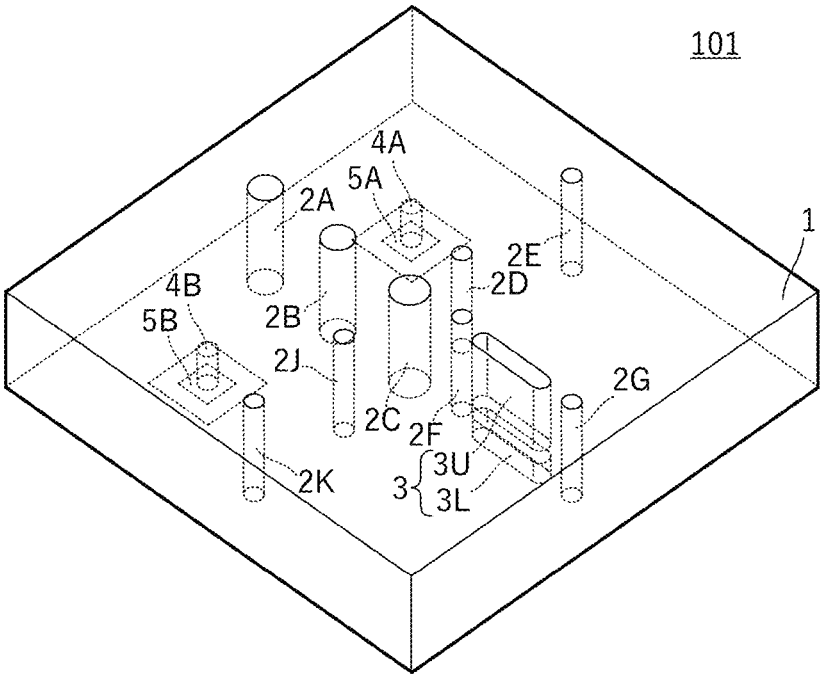
Figure 2A:
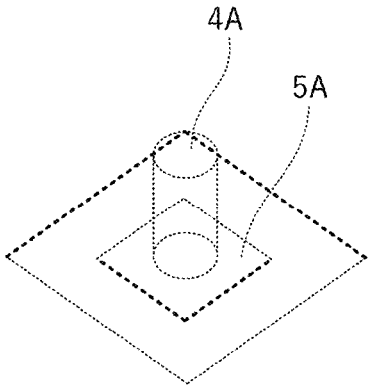
FIG. 2A is an enlarged perspective view illustrating structures of an input/output post and an input/output pad and FIG. 2B is an enlarged perspective view illustrating structures of non-penetrating posts 3U and 3L.
Figure 2B:
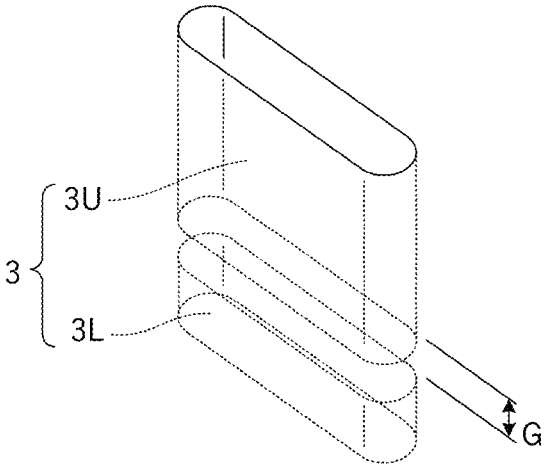

FIG. 1A is an external perspective view of a dielectric waveguide filter 101 according to a first preferred embodiment of the present invention and FIG. 1B is a transparent perspective view illustrating an internal structure of the dielectric waveguide filter 101. FIG. 2A is an enlarged perspective view illustrating structures of an input/output post and an input/output pad and FIG. 2B is an enlarged perspective view illustrating structures of non-penetrating posts 3U and 3L. Further, FIG. 3A is a perspective view illustrating four dielectric waveguide resonator portions included in the dielectric waveguide filter 101 and FIG. 3B is a perspective view illustrating a main coupling portion and a sub coupling portion included in the dielectric waveguide filter 101.

The dielectric waveguide filter 101 is structured in a dielectric block 1 having a rectangular or substantially rectangular parallelepiped shape. The dielectric block 1 is formed by processing dielectric ceramic, crystal, resin, and the like into a rectangular parallelepiped shape, for example. Input/output pads 5A and 5B are formed on the bottom surface of the dielectric block 1. The dielectric block 1 includes input/output posts 4A and 4B respectively protruding from the input/output pads 5A and 5B to the inside of the dielectric block 1. Further, the dielectric block 1 includes penetrating posts 2A to 2G, 2J and 2K penetrating from the upper surface to the lower surface of the dielectric block 1. Furthermore, the dielectric block 1 includes a non-penetrating post 3U, which penetrates into the dielectric block 1 from the upper surface thereof to a predetermined depth, and a non-penetrating post 3L, which penetrates into the dielectric block 1 from the lower surface thereof to a predetermined depth.

Conductor films are provided on outer surfaces of the dielectric block 1 and inner surfaces of each penetrating post and each non-penetrating post. Surrounding portions of the input/output pads 5A and 5B are isolated from a conductor film which is used as a ground conductor. This conductor film includes a metalizing paste for an Ag electrode, for example.

Figure 3A:
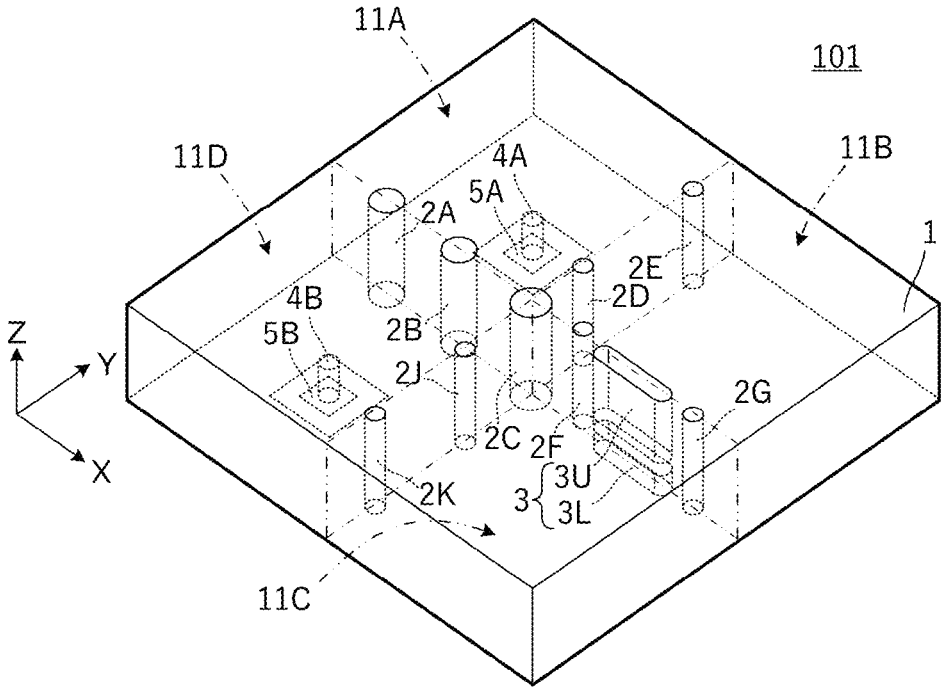
FIG. 3A is a perspective view illustrating four dielectric waveguide resonator portions included in the dielectric waveguide filter 101 and FIG. 3B is a perspective view illustrating a main coupling portion and a sub coupling portion included in the dielectric waveguide filter 101.
Figure 3B:
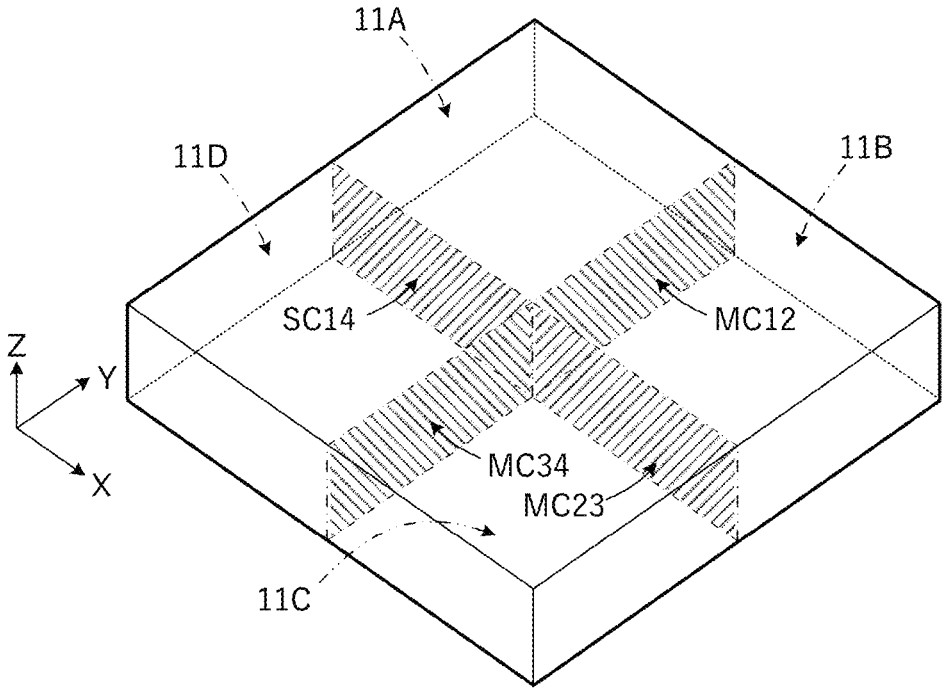

In FIGS. 3A and 3B, dashed-two dotted lines are virtual lines indicating sections for dielectric waveguide resonators structured in the dielectric block 1. The dielectric waveguide filter 101 includes four dielectric waveguide resonators 11A, 11B, 11C, and 11D. The dielectric waveguide resonator 11A corresponds to a first dielectric waveguide resonator, the dielectric waveguide resonator 11B corresponds to a second dielectric waveguide resonator, the dielectric waveguide resonator 11C corresponds to a third dielectric waveguide resonator, and the dielectric waveguide resonator 11D corresponds to a fourth dielectric waveguide resonator.

Hereinafter, a "dielectric waveguide resonator" is referred to merely as a "resonator". The resonators 11A, 11B, 11C, and 11D are resonators whose fundamental mode is a TE101 mode. That is, a resonant mode thereof has electromagnetic distribution in which the Z direction is an electric field direction and a magnetic field rotates in a surface direction parallel or substantially parallel to the X-Y surface, and there is one peak of electric field strength in each of the X direction and the Y direction.

A main coupling portion MC12 is provided between the resonators 11A and 11B, a main coupling portion MC23 is provided between the resonators 11B and 11C, a main coupling portion MC34 is provided between the resonators 11C and 11D, and a sub coupling portion SC14 is provided between the resonators 11A and 11D.

The main coupling portion MC12 illustrated in FIG. 3B is provided with the penetrating posts 2C, 2D, and 2E illustrated in FIG. 3A. Further, the main coupling portion MC34 illustrated in FIG. 3B is provided with the penetrating posts 2C, 2J, and 2K illustrated in FIG. 3A. The sub coupling portion SC14 illustrated in FIG. 3B is provided with the penetrating posts 2A, 2B, and 2C illustrated in FIG. 3As. The main coupling portion MC23 illustrated in FIG. 3B is provided with the penetrating posts 2C, 2F and 2G and the non-penetrating posts 3U and 3L illustrated in FIG. 3A.

The main coupling portion MC12 acts as an inductive coupling window, with the penetrating posts 2C, 2D, and 2E, that limits the width orthogonal or substantially orthogonal to the electric field direction of the resonators 11A and 11B (the width in the Y direction), so that the resonators 11A and 11B are inductively coupled with each other. The main coupling portion MC34 acts as an inductive coupling window, with the penetrating posts 2C, 2J, and 2K, that limits the width orthogonal or substantially orthogonal to the electric field direction of the resonators 11C and 11D (the width in the Y direction), so that the resonators 11C and 11D are inductively coupled with each other. The sub coupling portion SC14 acts as an inductive coupling window, with the penetrating posts 2A, 2B, and 2C, that limits the width orthogonal or substantially orthogonal to the electric field direction of the resonators 11A and 11D (the width in the X direction), so that the resonators 11A and 11D are inductively coupled with each other. On the other hand, regarding the main coupling portion MC23, a gap between the non-penetrating post 3U and the non-penetrating post 3L (G shown in FIG. 2B) acts as a capacitive coupling window that limits the width of the electric field direction (the Z direction) of the resonators 11B and 11C, so that the resonators 11B and 11C are capacitively coupled with each other. Here, the penetrating posts 2C, 2F, and 2G limit the width orthogonal or substantially orthogonal to the electric field direction of the resonators 11B and 11C (the width in the X direction), but the action of the non-penetrating posts 3U and 3L to limit the width in the electric field direction (the Z direction) is stronger, such that the resonators 11B and 11C are capacitively coupled with each other in this example.

Figure 4:
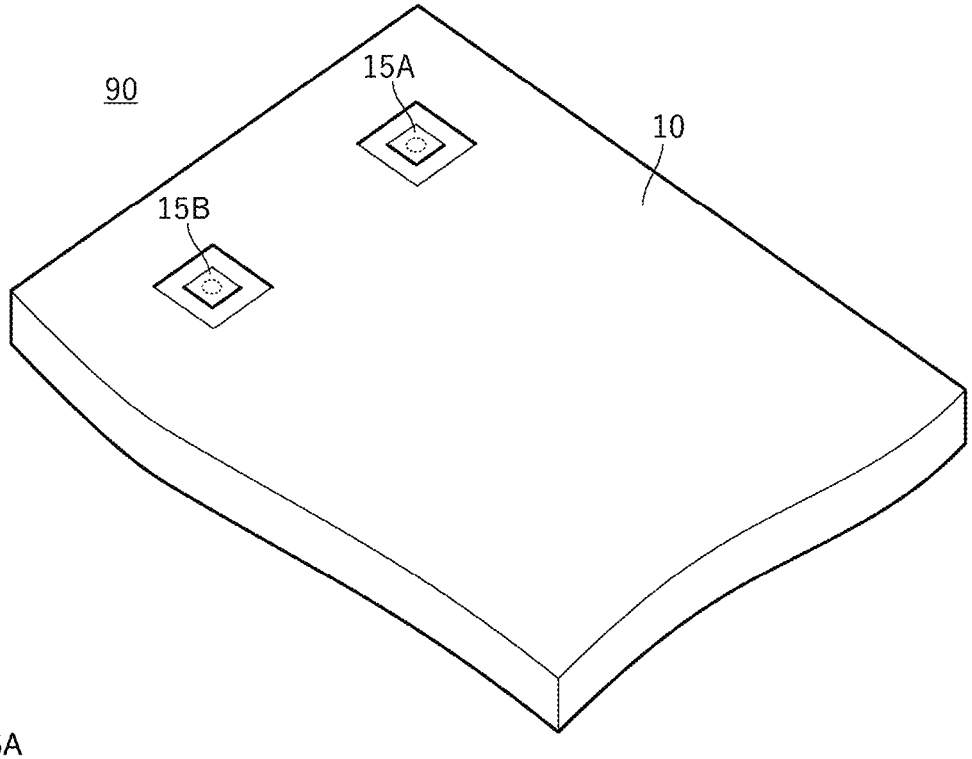
FIG. 4 is a partial perspective view of a circuit substrate 90 on which the dielectric waveguide filter 101 is to be mounted.

FIG. 4 is a partial perspective view of a circuit substrate 90 on which the dielectric waveguide filter 101 is to be mounted. On the circuit substrate 90, a ground conductor 10 and input/output lands 15A and 15B are provided. In a state in which the dielectric waveguide filter 101 is surface-mounted on the circuit substrate 90, the input/output pads 5A and 5B of the dielectric waveguide filter 101 are respectively connected with the input/output lands 15A and 15B and the ground conductor provided on the bottom surface of the dielectric waveguide filter 101 is connected with the ground conductor 10 of the circuit substrate 90.

A transmission line, such as a strip line, a microstrip line, and a coplanar line, for example, which leads to the input/output lands 15A and 15B is provided on the circuit substrate 90.

Figure 5A:
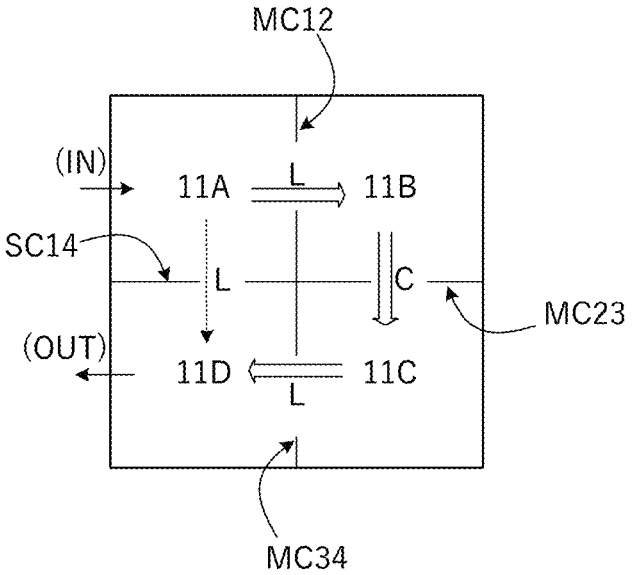
FIGS. 5A and 5B are diagrams illustrating a coupling structure including four resonators defining the dielectric waveguide filter 101.
Figure 5B:
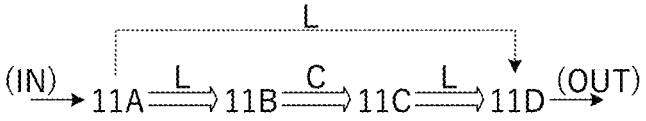

FIGS. 5A and 5B are diagrams illustrating a coupling structure of four resonators defining the dielectric waveguide filter 101 according to the present preferred embodiment. In FIGS. 5A and 5B, the resonator 11A is on the first stage (initial stage), the resonator 11B is on the second stage, the resonator 11C is on the third stage, and the resonator 11D is on the fourth stage (final stage). In FIGS. 5A and 5B, a path denoted by a double line is a main coupling path and a dashed line denotes a sub coupling path. Further, in FIGS. 5A and 5B, "L" denotes inductive coupling and "C" denotes capacitive coupling.

In the dielectric waveguide filter 101 according to the present preferred embodiment, the resonators 11A, 11B, 11C, and 11D are arranged along a main coupling path for signal propagation, the main coupling portion MC12 is an inductive coupling portion, the main coupling portion MC23 is a capacitive coupling portion, and the main coupling portion MC34 is an inductive coupling portion. That is, the main coupling portion includes an inductive coupling portion or a capacitive coupling portion and the inductive coupling portion and the capacitive coupling portion are alternately and repeatedly arranged along the main coupling path.

Further, in the dielectric waveguide filter 101 according to the present preferred embodiment, the main coupling portion between the resonator 11A, which inputs/outputs a signal from/to an outside, and the resonator 11B, which is coupled with the resonator 11A, is an inductive coupling portion. In the same manner, the main coupling portion between the resonator 11D, which inputs/outputs a signal from/to an outside, and the resonator 11C, which is coupled with the resonator 11D, is an inductive coupling portion.

Also, in the dielectric waveguide filter 101 according to the present preferred embodiment, the resonator 11A and the resonator 11D are arranged along a sub coupling path as well as along the main coupling path. That is, the sub coupling portion SC14 is provided between the resonator 11A and the resonator 11D. The sub coupling portion SC14 is an inductive coupling portion and coupling by the sub coupling portion SC14 is weaker than coupling by the main coupling portions MC12, MC23, and MC34. Here, there is a method in which inductive coupling is indicated by a positive coupling coefficient and capacitive coupling is indicated by a negative coupling coefficient. In accordance with this indication method, it can be said that "an absolute value of a coupling coefficient of the sub coupling portion SC14 is smaller than absolute values of coupling coefficients of the main coupling portions MC12, MC23, and MC34".

Figure 6A:
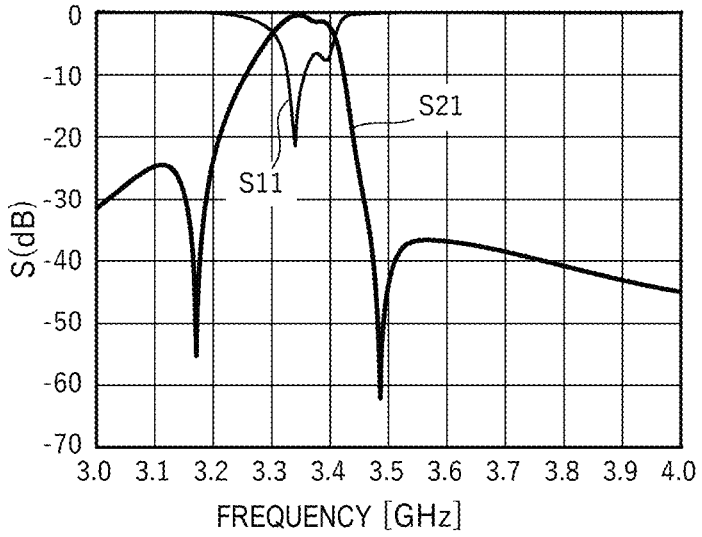
FIGS. 6A and 6B are diagrams illustrating frequency characteristics of reflection characteristics and bandpass characteristics of the dielectric waveguide filter 101.
Figure 6B:
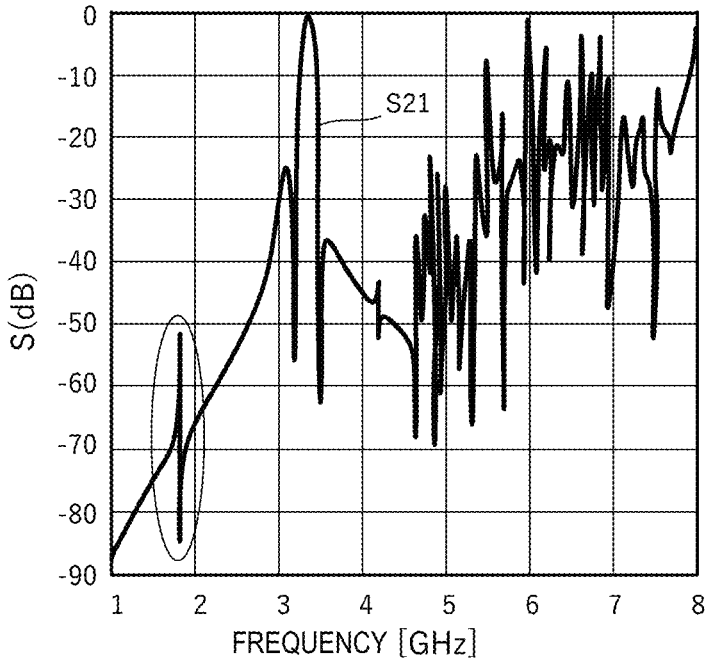

FIGS. 6A and 6B are diagrams illustrating frequency characteristics of reflection characteristics and bandpass characteristics of the dielectric waveguide filter 101. The range of the frequency axis in FIG. 6B is wider than that of FIG. 6A.

In FIGS. 6A and 6B, S11 denotes reflection characteristics and S21 denotes bandpass characteristics. The dielectric waveguide filter 101 according to the present preferred embodiment preferably has, for example, a pass band from about 3.3 GHz to about 3.4 GHz, has an attenuation pole on a low band side at about 3.17 GHz, and has an attenuation pole on a high band side at about 3.48 GHz as shown in FIG. 6A.

The reason for the appearance of such polar characteristics is described below.

First, regarding a transmission phase of a resonator, a phase is delayed by about 90° on a lower frequency side than a resonant frequency of the resonator and is advanced by about 90° on a higher frequency side than the resonant frequency. Further, a phase of inductive coupling is opposite to a phase of capacitive coupling. Therefore, when inductive coupling and capacitive coupling are combined, there is a frequency on which a signal running through the main coupling path and a signal running through the sub coupling path have inverted phases and the same or substantially the same amplitudes. An attenuation pole appears on this frequency. In the dielectric waveguide filter 101 according to the present preferred embodiment, the first resonator 11A and the second resonator 11B are inductively coupled with each other, the second resonator 11B and the third resonator 11C are capacitively coupled with each other, the third resonator 11C and the fourth resonator 11D are inductively coupled with each other, and the first resonator 11A and the fourth resonator 11D are sub-coupled with each other while jumping over the second resonator 11B and the third resonator 11C (jump coupling of even-number stages is performed), so that the phase on the main coupling path from the first resonator 11A to the fourth resonator 11D and the phase on the sub coupling path from the first resonator 11A to the fourth resonator 11D are mutually inverted on both of a lower band and a higher band than the pass band. That is, an attenuation pole appears on both of the lower band and the higher band than the pass band.

Further, since capacitive coupling portions do not continue along the main coupling path, excitation in a low order mode hardly occurs. Therefore, a spurious response (a portion enclosed with an oval in FIG. 6B) occurring in the lower frequency band than the pass band is very small.

The reason why a lower-order spurious response is thus reduced or prevented is described below.

Figure 7A:
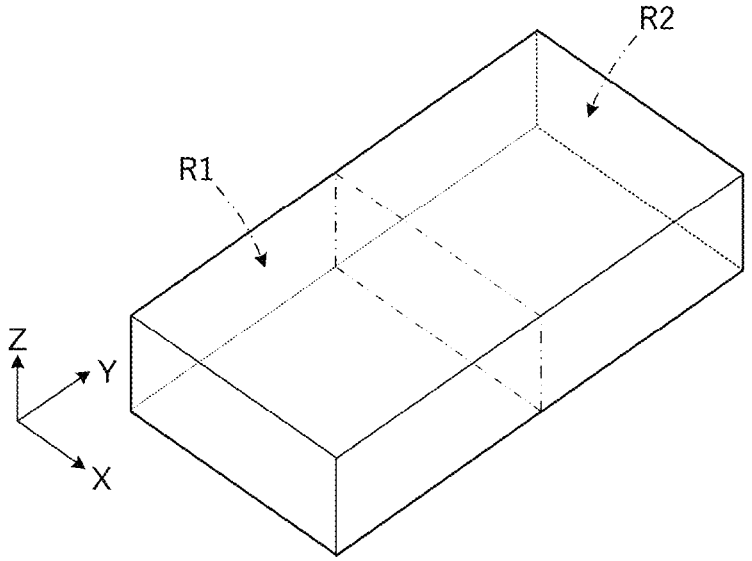
FIGS. 7A and 7B are schematic views of a resonance system including two adjacent dielectric waveguide resonators R1 and R2.
Figure 7B:
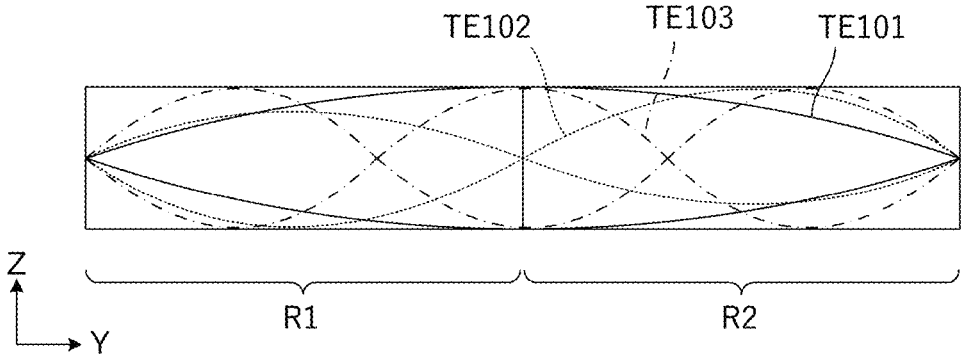

FIGS. 7A and 7B are schematic views of a resonance system including two adjacent resonators R1 and R2. FIG. 7A is a perspective view of the resonance system and FIG. 7B is a front elevational view of the same. FIG. 7B shows electric field waves of respective modes of TE101, TE102, and TE103 in an overlapping manner. Thus, there are resonant modes related to propagation modes TE10 as TE101, TE102, TE103, . . . in a lower frequency order in the resonance system including two resonators. Among these, the TE101 mode is in an in-phase relationship between the resonator R1 and the resonator R2, the resonant mode TE102 is in an inverse-phase relationship between the resonator R1 and the resonator R2, and the TE103 mode is in an in-phase relationship between the resonator R1 and the resonator R2. Here, if coupling between the TE101 mode (in-phase) and the TE102 mode (inverse-phase) is set as inductive coupling, coupling between the TE102 mode (inverse-phase) and the TE103 mode (in-phase) is coupling of an inverted phase with respect to inductive coupling, thus being capacitive coupling.

Thus, capacitive coupling is coupling of the TE102 mode being a high order mode and the TE103 mode being a high order mode, so that the TE101 mode being a low order resonant mode as a spurious response appears on the lower frequency side than a pass band. On the other hand, since inductive coupling is coupling of the TE101 mode being a fundamental mode and the TE102 mode (since there is no lower order mode), a spurious response does not occur on the lower frequency side than the pass band. Accordingly, by providing an arrangement in which a capacitive coupling portion is interposed between inductive coupling portions along the main coupling path, the above-described lower-order spurious response caused by the capacitive coupling is reduced or prevented.

Figure 8:
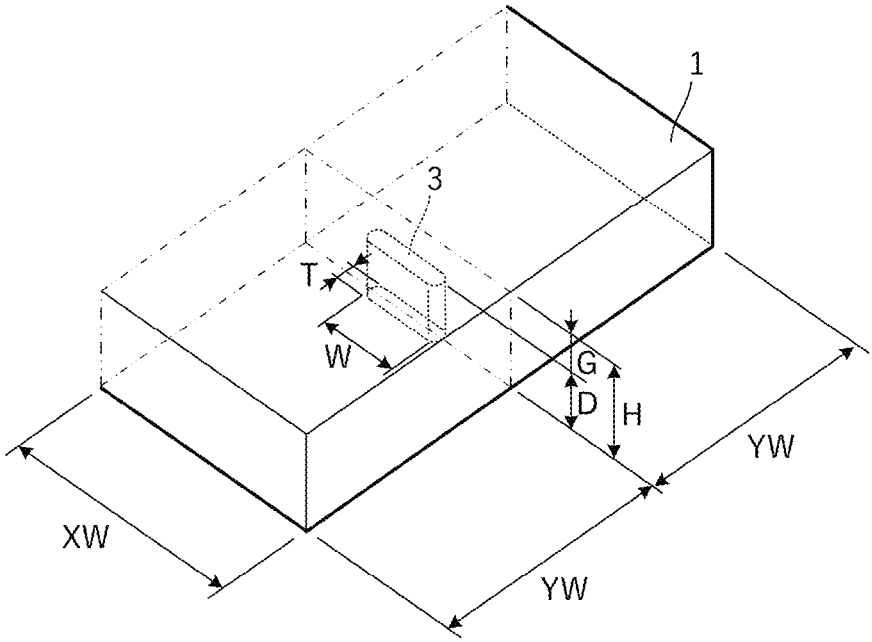
FIG. 8 is a transparent perspective view illustrating a structure of a capacitive coupling portion provided by a non-penetrating post obtained by simplifying the non-penetrating post 3 illustrated in FIG. 2B.

A setting structure for strong capacitive coupling is now described. FIG. 8 is a transparent perspective view illustrating a structure of a capacitive coupling portion provided by a non-penetrating post obtained by simplifying the non-penetrating post 3 illustrated in FIG. 2B. Here, the protrusion height (depth) from the lower surface of the dielectric block 1, the width, and the thickness of the non-penetrating post 3 are denoted by D, W, and T respectively. Here, preferably, W=about 6.6 mm and T=about 1.0 mm, for example. Further, the height H, the width XW in the X direction, and the width YW in the Y direction of each resonator are preferably, for example, about 5.5 mm, about 13 mm, and about 13 mm respectively.

Figure 9:
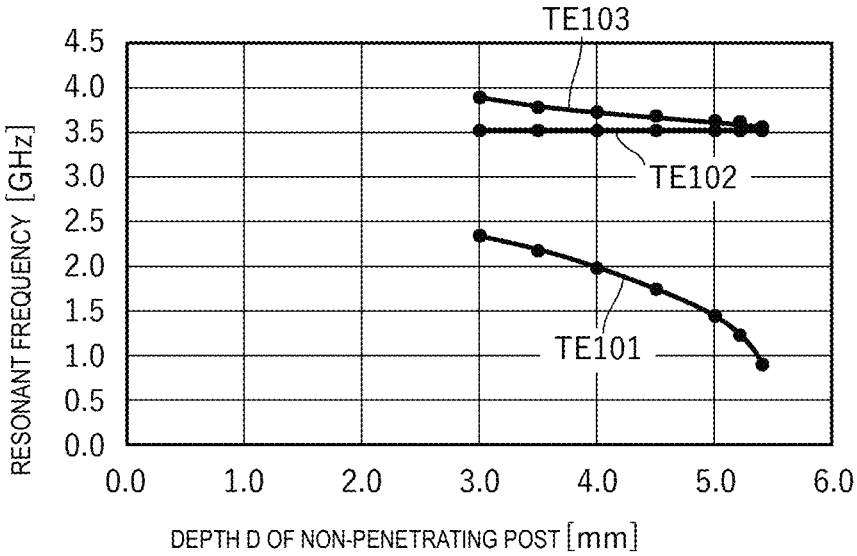
FIG. 9 is a diagram illustrating characteristics of each resonant mode with a horizontal axis indicating the depth of the non-penetrating post 3 and a vertical axis indicating a resonant frequency.

FIG. 9 is a diagram illustrating characteristics of each resonant mode with a horizontal axis indicating the depth of the non-penetrating post 3 and a vertical axis indicating a resonant frequency. Thus, as a non-penetrating hole is deeper, that is, as a gap of a capacitive coupling window is narrower, frequencies of the TE101 mode and the TE103 mode decrease, but the TE102 mode is not influenced. A frequency interval of each mode corresponds to coupling strength, so that coupling can be adjusted by the depth of the non-penetrating post. Accordingly, when the frequencies of the TE102 mode and the TE103 mode, in which capacitive coupling is provided, are set to frequencies around the pass band (about 3.5 GHz, for example), capacitive coupling suitable for filter characteristics in a target specification can be obtained.

Here, FIG. 8 illustrates the structure of the capacitive coupling portion defined by a single non-penetrating post obtained by simplifying the non-penetrating post 3 illustrated in FIG. 2B, but similar characteristics to those illustrated in FIG. 9 can be obtained with the gap G between two non-penetrating posts also when the non-penetrating posts are respectively provided from the upper and lower surfaces of the dielectric block as illustrated in FIG. 2B.

Second Preferred Embodiment

A second preferred embodiment of the present invention describes a dielectric waveguide filter in which the number of stages of resonators is different from that of the first preferred embodiment.

Figure 10A:
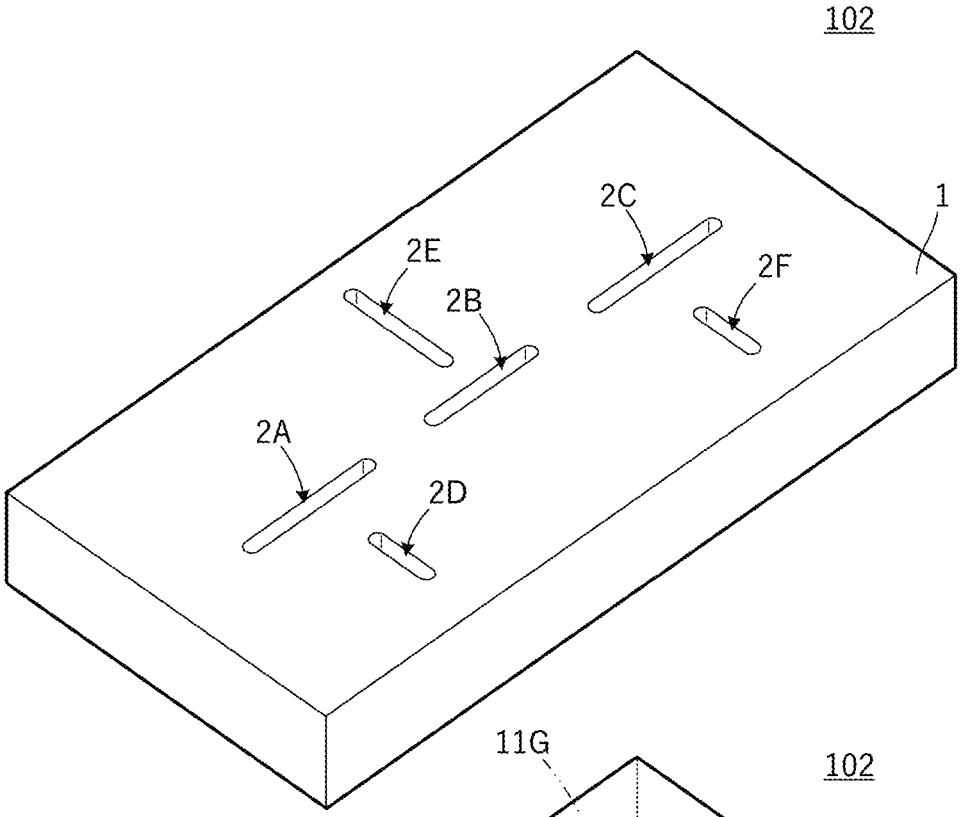
FIG. 10A is an external perspective view of a dielectric waveguide filter 102 according to a second preferred embodiment of the present invention and FIG. 10B is a transparent perspective view illustrating an internal structure of the dielectric waveguide filter 102.
Figure 10B:
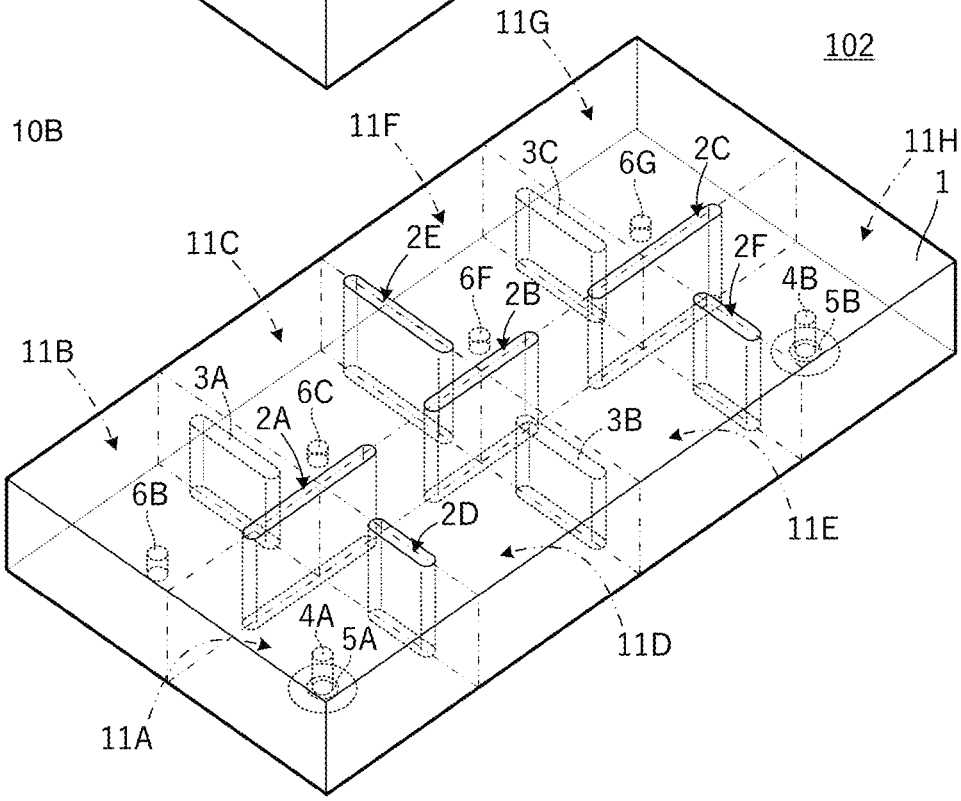

FIG. 10A is an external perspective view of a dielectric waveguide filter 102 according to the second preferred embodiment and FIG. 10B is a transparent perspective view illustrating an internal structure of the dielectric waveguide filter 102.

This dielectric waveguide filter 102 is structured in a dielectric block 1 having a rectangular or substantially rectangular parallelepiped shape. Input/output pads 5A and 5B are provided on the bottom surface of the dielectric block 1. The dielectric block 1 includes input/output posts 4A and 4B respectively protruding from the input/output pads 5A and 5B to the inside of the dielectric block 1. Further, the dielectric block 1 includes penetrating posts 2A, 2B, 2C, 2D, 2E, and 2F penetrating from the upper surface to the lower surface of the dielectric block 1. Furthermore, the dielectric block 1 includes non-penetrating posts 3A, 3B, and 3C which penetrate into the dielectric block 1 from the lower surface thereof to a predetermined depth. Furthermore, the dielectric block 1 includes resonant frequency adjustment posts 6B, 6C, 6F, and 6G which penetrate into the dielectric block 1 from the lower surface thereof to a predetermined depth.

Conductor films are provided on outer surfaces of the dielectric block 1 and inner surfaces of each penetrating post and each non-penetrating post. Surrounding portions of the input/output pads 5A and 5B are isolated from a conductor film which is used as a ground conductor.

In FIG. 10B, dashed-two dotted lines are virtual lines indicating sections for resonators structured in the dielectric block 1. The dielectric waveguide filter 102 includes eight resonators 11A to 11H. These resonators 11A to 11H are resonators whose fundamental mode is the TE101 mode.

Different from the dielectric waveguide filter 101 illustrated in FIG. 1B, the input/output pads 5A and 5B in the dielectric waveguide filter 102 according to the present preferred embodiment have a circular or substantially circular shape. The penetrating posts 2A, 2B, 2C, 2D, 2E, and 2F are holes having an elliptical cross section and define conductor walls having a predetermined width. Portions for providing these penetrating posts 2A, 2B, 2C, 2D, 2E, and 2F define inductive coupling portions and portions for providing the non-penetrating posts 3A, 3B, and 3C define capacitive coupling portions. The resonant frequency adjustment posts 6B, 6C, 6F, and 6G are provided so as to finely adjust resonant frequencies of the resonators 11B, 11C, 11F, and 11G respectively. Resonant frequencies of the resonators 11B, 11C, 11F, and 11G are set by respectively setting the height (depth) of these resonant frequency adjustment posts 6B, 6C, 6F, and 6G.

Figure 11A:
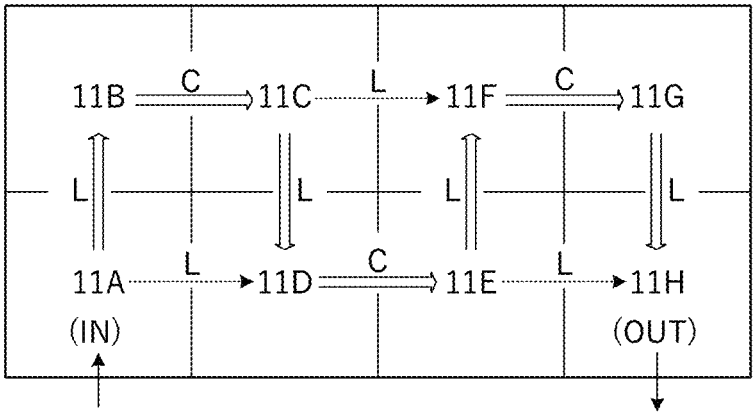
FIGS. 11A and 11B are diagrams illustrating a coupling structure including eight resonators defining the dielectric waveguide filter 102 according to a second preferred embodiment of the present invention.
Figure 11B:
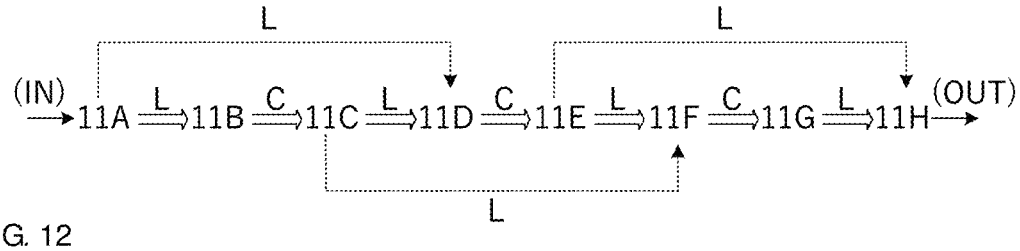

FIGS. 11A and 11B are diagrams illustrating a coupling structure of eight resonators defining the dielectric waveguide filter 102 according to the present preferred embodiment. In FIGS. 11A and 11B, the resonator 11A is on the first stage (initial stage) and the resonator 11H is on the eighth stage (final stage). Between the resonators 11A and 11H, the resonators 11B, 11C, 11D, 11E, 11F, and 11G on the second stage to the seventh stage are arranged in sequence.

In FIGS. 11A and 11B, a path denoted by a double line is a main coupling path and a dashed line denotes a sub coupling path. Further, in FIGS. 11A and 11B, "L" denotes inductive coupling and "C" denotes capacitive coupling.

In the dielectric waveguide filter 102 according to the present preferred embodiment, the resonators 11A to 11H are arranged along a main coupling path for signal propagation, a main coupling portion includes an inductive coupling portion or a capacitive coupling portion, and the inductive coupling portion and the capacitive coupling portion are alternately and repeatedly arranged along the main coupling path.

Further, in the dielectric waveguide filter 102 according to the present preferred embodiment, the main coupling portion between the resonator 11A, which inputs/outputs a signal from/to an outside, and the resonator 11B, which is coupled with the resonator 11A, is an inductive coupling portion. In the same manner, the main coupling portion between the resonator 11H, which inputs/outputs a signal from/to an outside, and the resonator 11G, which is coupled with the resonator 11H, is an inductive coupling portion.

Also, in the dielectric waveguide filter 102 according to the present preferred embodiment, the resonator 11A and the resonator 11D are sub-coupled (jump-coupled) with each other by a sub coupling portion which is an inductive coupling portion. Further, the resonator 11C and the resonator 11F are sub-coupled (jump-coupled) with each other by a sub coupling portion which is an inductive coupling portion. Furthermore, the resonator 11E and the resonator 11H are sub-coupled (jump-coupled) with each other by a sub coupling portion which is an inductive coupling portion. Coupling by the sub coupling portions is weaker than coupling by the main coupling portions.

Figure 12:
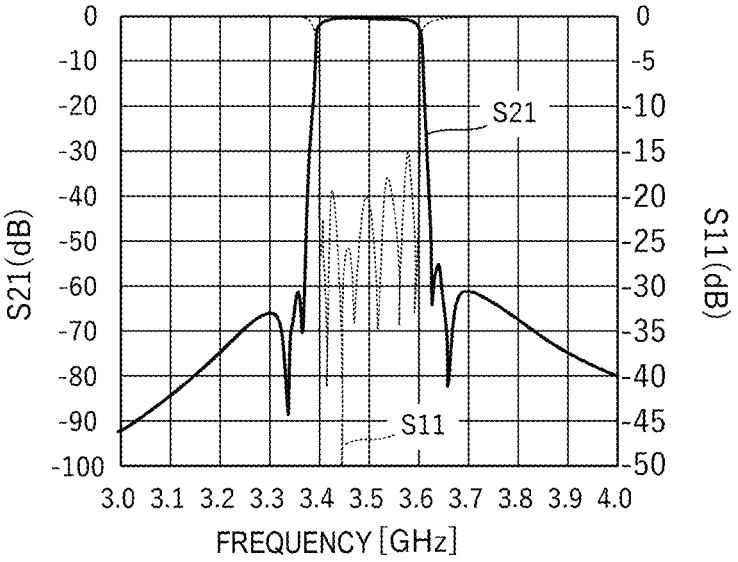
FIG. 12 is a diagram illustrating frequency characteristics of reflection characteristics and bandpass characteristics of the dielectric waveguide filter 102.

FIG. 12 is a diagram illustrating frequency characteristics of reflection characteristics and bandpass characteristics of the dielectric waveguide filter 102. In FIG. 12, S11 denotes reflection characteristics and S21 denotes bandpass characteristics. The dielectric waveguide filter 102 according to the present preferred embodiment preferably has, for example, a pass band from about 3.4 GHz to about 3.6 GHz, has attenuation poles on a low band side at about 3.34 GHz and about 3.36 GHz, and has attenuation poles on a high band side at about 3.63 GHz and about 3.66 GHz.

The resonators 11A to 11D respectively correspond to the first resonator to the fourth resonator according to a preferred embodiment of the present invention. The resonators 11C to 11F also correspond to the first resonator to the fourth resonator according to a preferred embodiment of the present invention respectively. Further, the resonators 11E to 11H also correspond to the first resonator to the fourth resonator according to a preferred embodiment of the present invention respectively.

Thus, a plurality of groups of four resonators may be provided. Similarly to the dielectric waveguide filter 101 of the first preferred embodiment, the number of capacitive coupling portions is also smaller than the number of inductive coupling portions among a plurality of coupling portions defining the main coupling portions and the sub coupling portions in the dielectric waveguide filter 102 according to the present preferred embodiment. Therefore, excitation in a low order mode caused by capacitive coupling does not predominantly appear, thus reducing or preventing a spurious response occurring in a lower band than a pass band.

Third Preferred Embodiment

A third preferred embodiment of the present invention describes some examples of a dielectric waveguide filter in which structures of inductive coupling portions and capacitive coupling portions are different from those of the dielectric waveguide filter described in the second preferred embodiment.

Figure 13A:
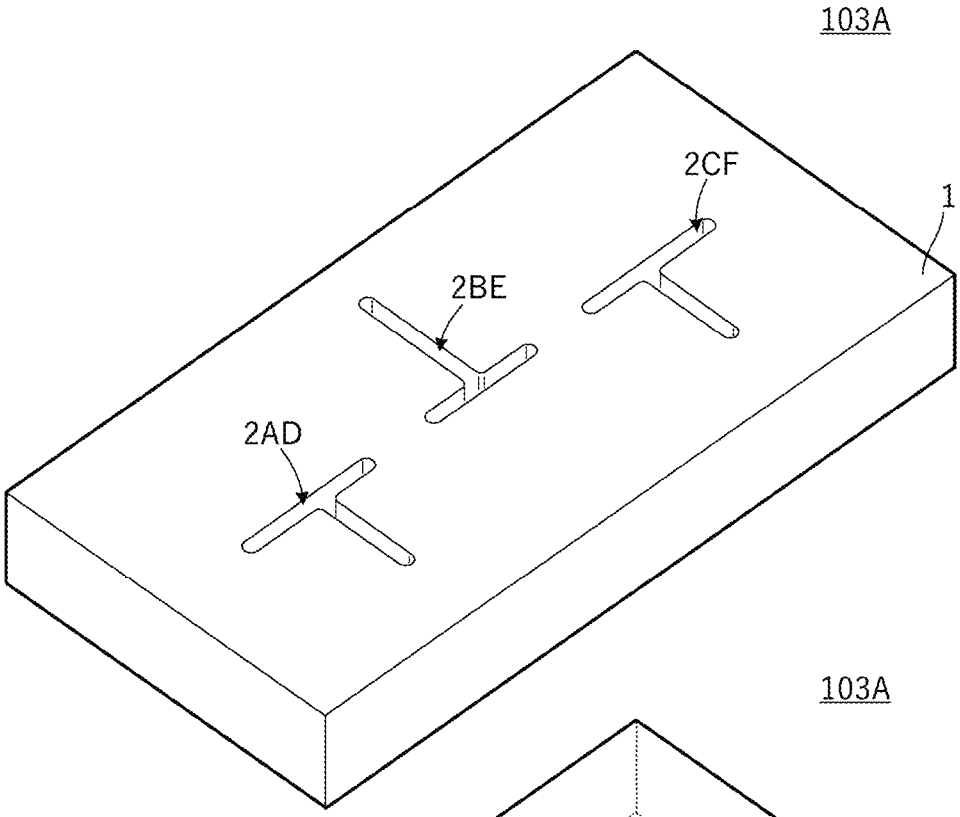
FIG. 13A is an external perspective view of a dielectric waveguide filter 103A according to a third preferred embodiment of the present invention and FIG. 13B is a transparent perspective view illustrating an internal structure of the dielectric waveguide filter 103A.
Figure 13B:
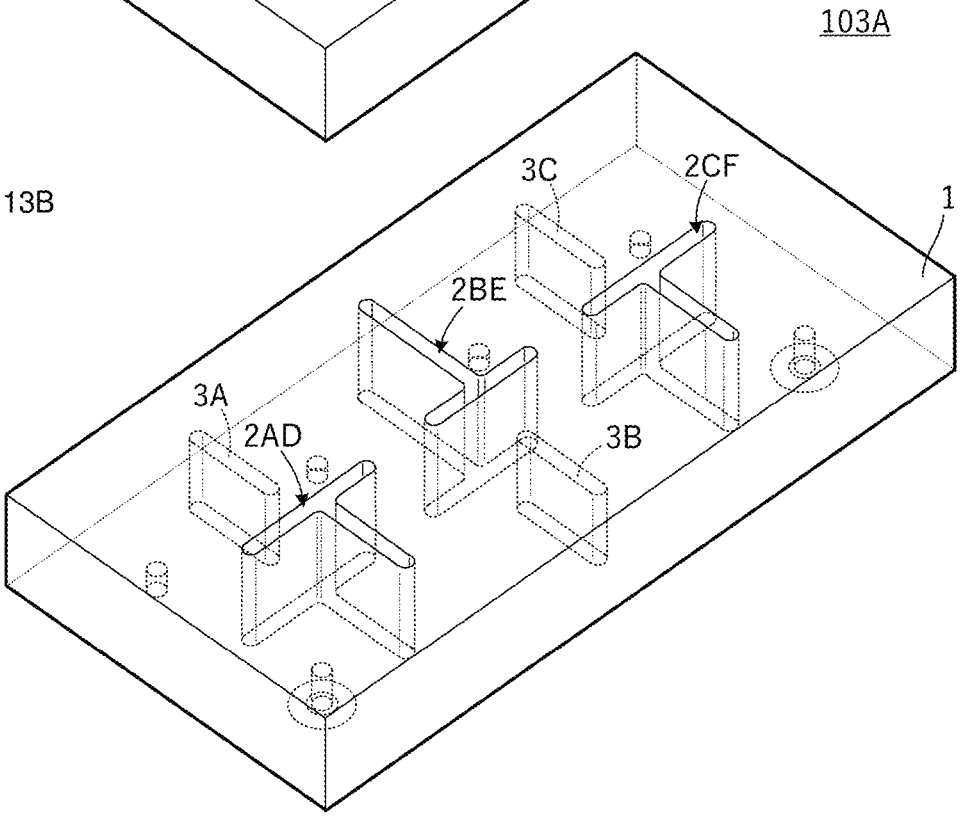

FIG. 13A is an external perspective view of a dielectric waveguide filter 103A according to the third preferred embodiment and FIG. 13B is a transparent perspective view illustrating an internal structure of the dielectric waveguide filter 103A.

The dielectric waveguide filter 103A is structured in a dielectric block 1 having a rectangular or substantially rectangular parallelepiped shape. The dielectric block 1 includes penetrating posts 2AD, 2BE, and 2CF penetrating from the upper surface to the lower surface of the dielectric block 1. The penetrating post 2AD is provided by connecting and integrating the penetrating post 2A and the penetrating post 2D included in the dielectric waveguide filter 102 illustrated in FIG. 10B. Further, the penetrating post 2BE is provided by connecting and integrating the penetrating post 2B and the penetrating post 2E included in the dielectric waveguide filter 102 illustrated in FIGS. 10A and 10B. Furthermore, the penetrating post 2CF is provided by connecting and integrating the penetrating post 2C and the penetrating post 2F included in the dielectric waveguide filter 102 illustrated in FIG. 10B. All of the penetrating posts have, for example, a T shape in a plan view. Structures of other components are the same as or similar to those of the dielectric waveguide filter 102 described in the second preferred embodiment.

As illustrated in FIGS. 13A and 13B, an inductive coupling portion of a main coupling portion and an inductive coupling portion of a sub coupling portion may be defined by an integrated post.

Figure 14A:
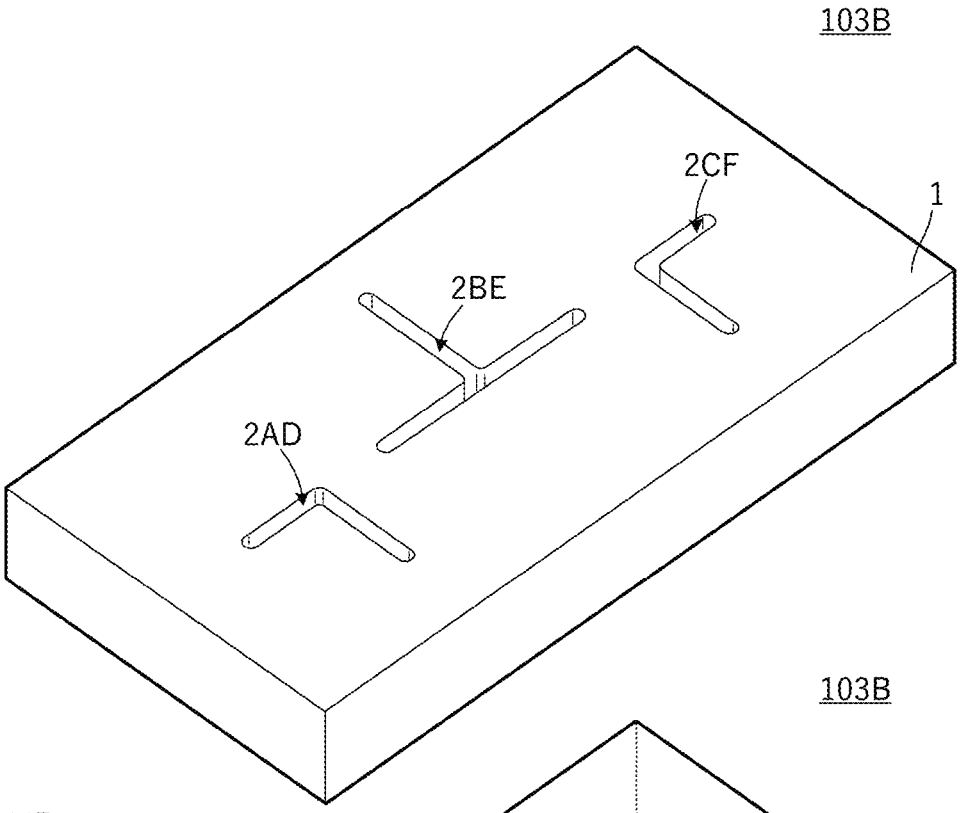
FIG. 14A is an external perspective view of another dielectric waveguide filter 103B according to the third preferred embodiment of the present invention and FIG. 14B is a transparent perspective view illustrating an internal structure of the dielectric waveguide filter 103B.
Figure 14B:
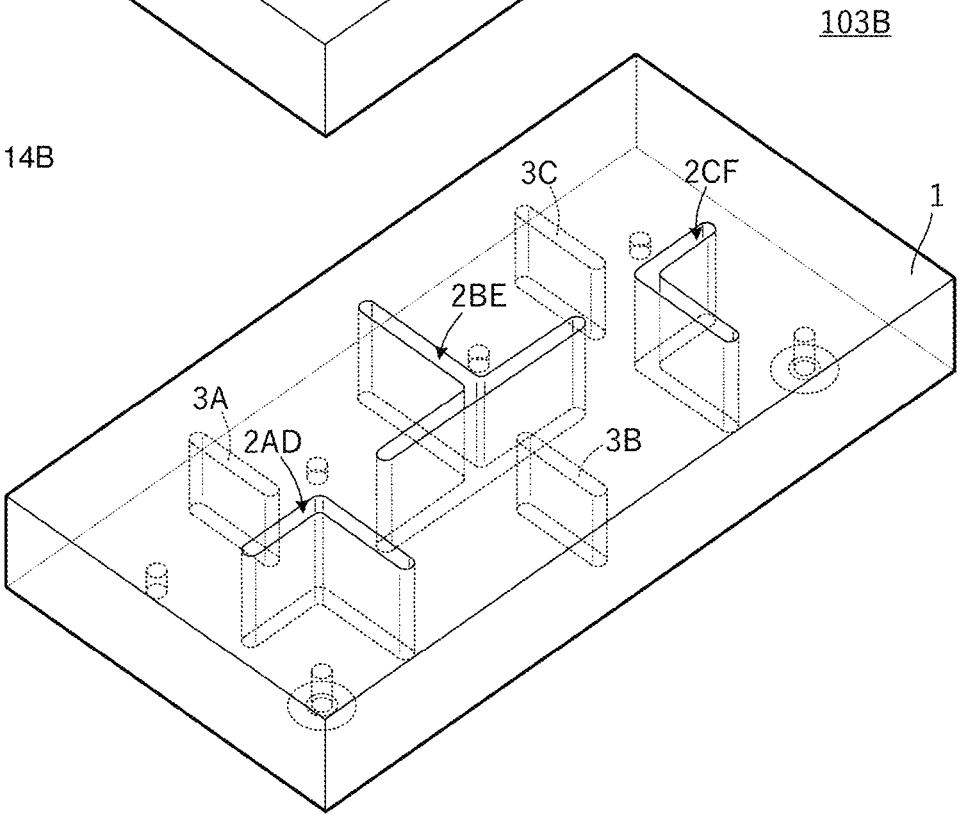

FIG. 14A is an external perspective view of another dielectric waveguide filter 103B according to the third preferred embodiment and FIG. 14B is a transparent perspective view illustrating an internal structure of the dielectric waveguide filter 103B.

The dielectric waveguide filter 103B is structured in a dielectric block 1 having a rectangular or substantially rectangular parallelepiped shape. The dielectric block 1 includes penetrating posts 2AD, 2BE, and 2CF penetrating from the upper surface to the lower surface of the dielectric block 1. Similarly to the dielectric waveguide filter 103A illustrated in FIG. 13B, the penetrating post 2AD is provided by connecting and integrating the penetrating post 2A and the penetrating post 2D included in the dielectric waveguide filter 102 illustrated in FIG. 10B. Further, the penetrating post 2BE is provided by connecting and integrating the penetrating post 2B and the penetrating post 2E included in the dielectric waveguide filter 102 illustrated in FIG. 10B. Furthermore, the penetrating post 2CF is provided by connecting and integrating the penetrating post 2C and the penetrating post 2F included in the dielectric waveguide filter 102 illustrated in FIG. 10B. The penetrating posts 2AD and 2CF have an L shape in a plan view and the penetrating post 2BE has a T shape, for example, in a plan view. Structures of other components are the same as or similar to those of the dielectric waveguide filter 102 described in the second preferred embodiment.

As illustrated in FIGS. 13A, 13B, FIGS. 14A, and 14B, penetrating posts defining inductive coupling portions may be continued over a plurality of coupling portions.

Figure 15A:
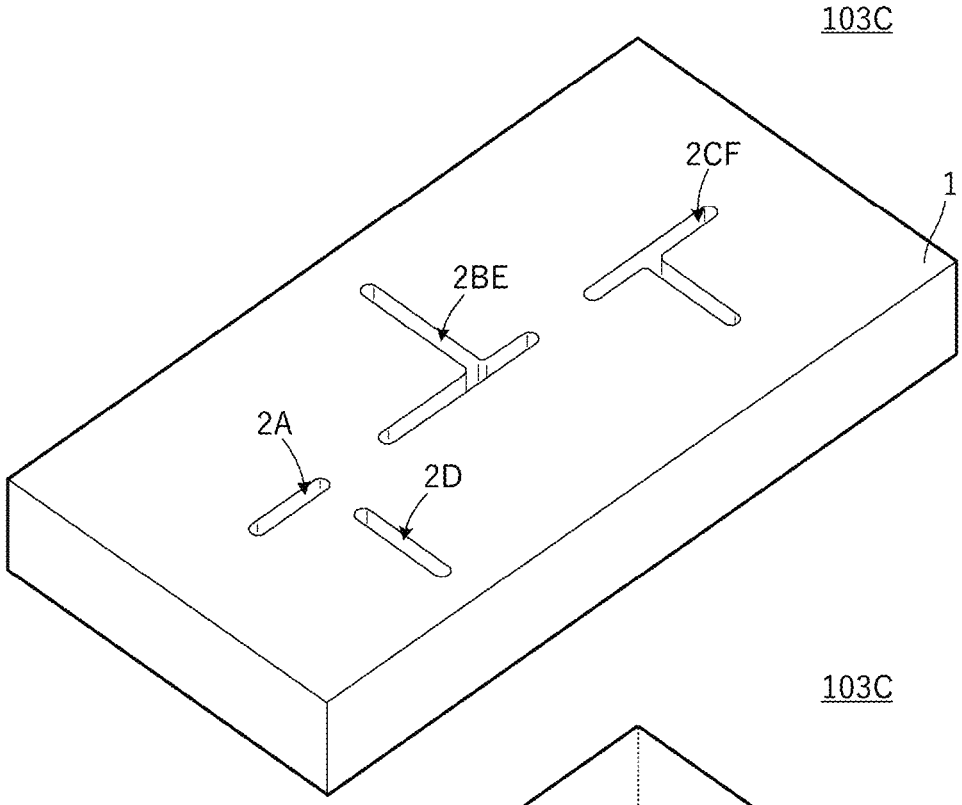
FIG. 15A is an external perspective view of another dielectric waveguide filter 103C according to the third preferred embodiment of the present invention and FIG. 15B is a transparent perspective view illustrating an internal structure of the dielectric waveguide filter 103C.
Figure 15B:
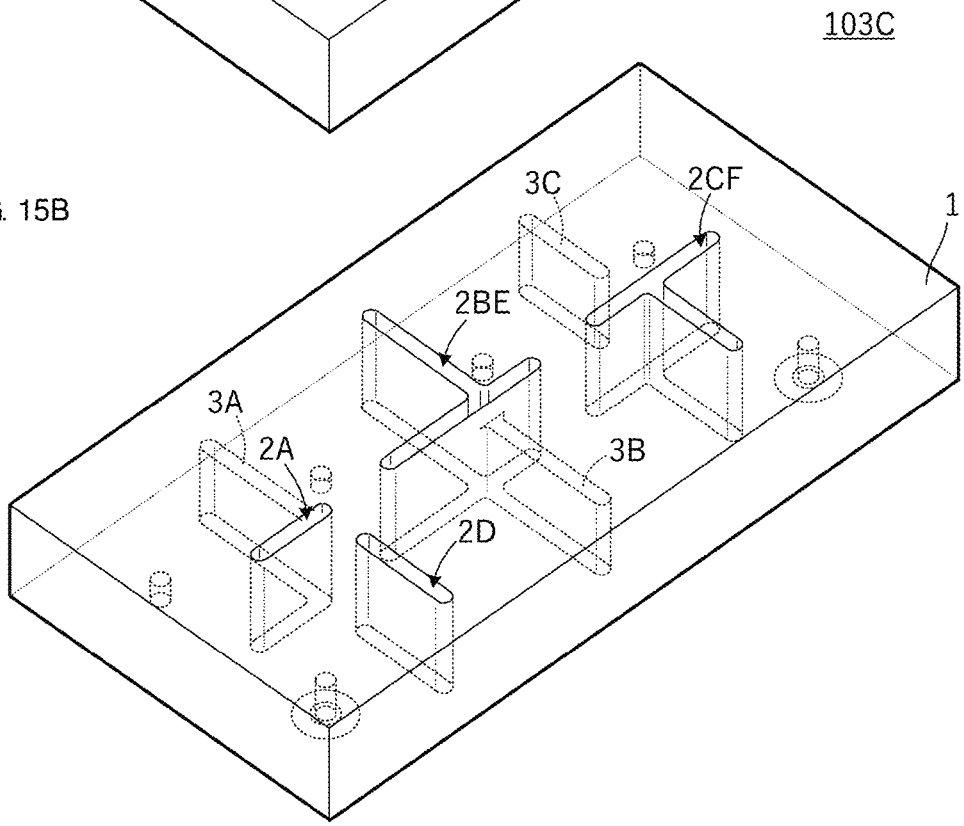

FIG. 15A is an external perspective view of another dielectric waveguide filter 103C according to the third preferred embodiment and FIG. 15B is a transparent perspective view illustrating an internal structure of the dielectric waveguide filter 103C.

The dielectric waveguide filter 103C is structured in a dielectric block 1 having a rectangular or substantially rectangular parallelepiped shape. The dielectric block 1 includes penetrating posts 2A, 2BE, 2CF, and 2D penetrating from the upper surface to the lower surface of the dielectric block 1. Further, the dielectric block 1 includes non-penetrating posts 3A, 3B, and 3C which penetrate into the dielectric block 1 from the lower surface thereof to a predetermined depth. The penetrating post 2A and the non-penetrating post 3A are connected to be integrated. Further, the penetrating post 2BE and the non-penetrating post 3B are connected to be integrated. The penetrating post 2CF is provided by connecting and integrating the penetrating post 2C and the penetrating post 2F included in the dielectric waveguide filter 102 illustrated in FIG. 10B.

As illustrated in FIGS. 15A and 15B, a penetrating post defining an inductive coupling portion and a non-penetrating post defining a capacitive coupling portion may be continued. Further, a capacitive coupling portion of a main coupling portion and an inductive coupling portion of a sub coupling portion may be thus defined by an integrated post.

In a similar manner, when sub coupling portions of capacitive coupling are included, an inductive coupling portion of a main coupling portion and a capacitive coupling portion of the sub coupling portion may be defined by an integrated post. Further, a capacitive coupling portion of a main coupling portion and a capacitance coupling portion of the sub coupling portion may be defined by an integrated post.

Here, the structure is described above in which the main coupling portion and the sub coupling portion are defined by an integrated common post, but an inductive coupling portion of a main coupling portion and a capacitive coupling portion of a main coupling portion may be defined by an integrated post as illustrated in FIGS. 15A and 15B, for example. Similarly, a capacitive coupling portion of a main coupling portion and a capacitive coupling portion of a main coupling portion may be defined by an integrated post.

Fourth Preferred Embodiment

A fourth preferred embodiment of the present invention describes an example of a dielectric waveguide filter in which a jump-coupled portion has a different structure from those described above.

Figure 16A:
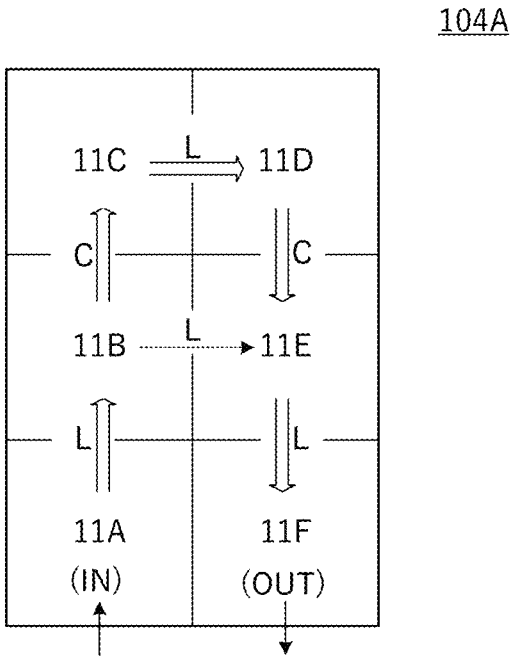
FIGS. 16A and 16B are diagrams illustrating a coupling structure including six resonators defining a dielectric waveguide filter 104A according to a fourth preferred embodiment of the present invention.
Figure 16B:
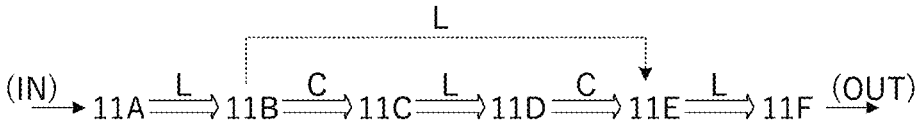

FIGS. 16A and 16B are diagrams illustrating a coupling structure of six resonators defining a dielectric waveguide filter 104A according to the fourth preferred embodiment. In FIGS. 16A and 16B, a resonator 11A is on the first stage (initial stage) and a resonator 11F is on the sixth stage (final stage). Between the resonators 11A and 11F, resonators 11B, 11C, 11D, and 11E on the second stage to the fifth stage are arranged in sequence.

In FIGS. 16A and 16B, a path denoted by a double line is a main coupling path and a dashed line denotes a sub coupling path. Further, in FIGS. 16A and 16B, "L" denotes inductive coupling and "C" denotes capacitive coupling.

In the dielectric waveguide filter 104A according to the present preferred embodiment, the resonators 11A to 11F are arranged along a main coupling path for signal propagation, a main coupling portion includes an inductive coupling portion or a capacitive coupling portion, and the inductive coupling portion and the capacitive coupling portion are alternately and repeatedly arranged along the main coupling path.

Also, in the dielectric waveguide filter 104A according to the present preferred embodiment, the resonator 11B and the resonator 11E are sub-coupled (jump-coupled) with each other by a sub coupling portion which is an inductive coupling portion. In the above-described preferred embodiments, two resonators which are coupled with each other by sub-coupling are coupled in an order of inductive coupling⇒capacitive coupling⇒inductive coupling on a main coupling path. However, in the dielectric waveguide filter 104A according to the present preferred embodiment illustrated in FIGS. 16A and 16B, the resonator 11B and the resonator 11E which are coupled with each other by sub-coupling are coupled in an order of capacitive coupling⇒inductive coupling⇒capacitive coupling on a main coupling path. Also, the resonator 11B and the resonator 11E are inductively coupled with each other on a sub coupling path.

Two resonators which are coupled with each other in the order of capacitive coupling⇒inductive coupling⇒capacitive coupling on a main coupling path may thus be sub-coupled with each other.

Figure 17A:
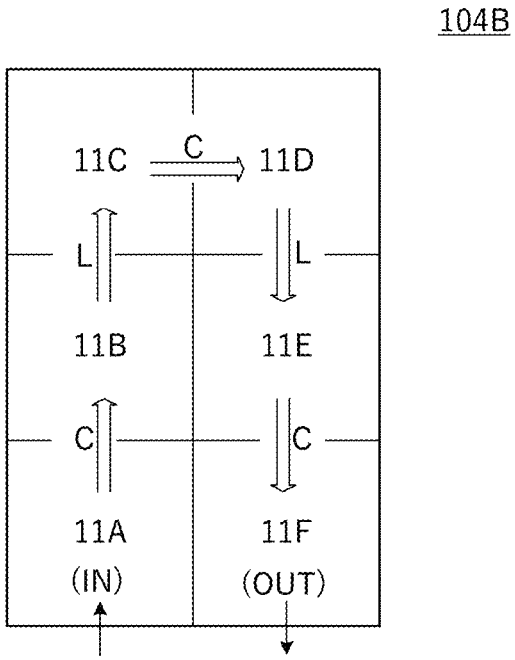
FIGS. 17A and 17B are diagrams illustrating a coupling structure including six resonators defining another dielectric waveguide filter 104B according to the fourth preferred embodiment of the present invention.
Figure 17B:
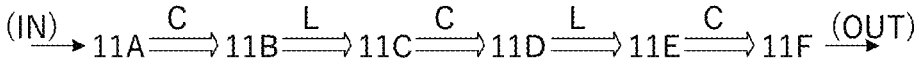

FIGS. 17A and 17B are diagrams illustrating a coupling structure of six resonators defining another dielectric waveguide filter 104B according to the fourth preferred embodiment. In FIGS. 17A and 17B, a resonator 11A is on the first stage (initial stage) and a resonator 11F is on the sixth stage (final stage). Between the resonators 11A and 11F, resonators 11B, 11C, 11D, and 11E on the second stage to the fifth stage are arranged in sequence.

In FIGS. 17A and 17B, a path denoted by a double line is a main coupling path. Further, in FIGS. 17A and 17B, "L" denotes inductive coupling and "C" denotes capacitive coupling. This dielectric waveguide filter 104B does not include a sub coupling path. That is, there is no jump coupling.

In the dielectric waveguide filter 104B according to the present preferred embodiment, the resonators 11A to 11F are arranged along a main coupling path for signal propagation, a main coupling portion includes an inductive coupling portion or a capacitive coupling portion, and the inductive coupling portion and the capacitive coupling portion are alternately and repeatedly arranged along the main coupling path. In the above-described preferred embodiments, a resonator on an input/output stage and a resonator which is main-coupled with the resonator on the input/output stage are inductively coupled. On the other hand, in this dielectric waveguide filter 104B, the resonator 11A on the first stage (initial stage) and the resonator 11B on the second stage are capacitively coupled with each other, and the resonator 11F on the sixth stage (final stage) and the resonator 11E on the fifth stage are capacitively coupled with each other.

It is preferable not to capacitively sub-couple (jump-couple) the resonator 11B on the second stage with the resonator 11E on the fifth stage. If they are capacitively coupled with each other, capacitive coupling continues through three stages on the path of the resonators 11A-411B-411E-411F. In other words, it is preferable that a main coupling portion between a resonator, which inputs/outputs a signal from/to an outside, and a resonator, which is coupled with the resonator performing the input/output is an inductive coupling portion among a plurality of main coupling portions, as illustrated in FIGS. 16A and 16B. Even if these two resonators (the resonator 11B and the resonator 11E in the example illustrated in FIGS. 16A and 16B) are capacitively sub-coupled with each other, capacitive coupling does not continue through three stages. Accordingly, an attenuation pole can be easily provided by a sub coupling portion.

Thus, the structure may be used in which a resonator on an input/output stage and a resonator which is main-coupled with the resonator on the input/output stage are capacitively coupled with each other.

Fifth Preferred Embodiment

Figure 18A:
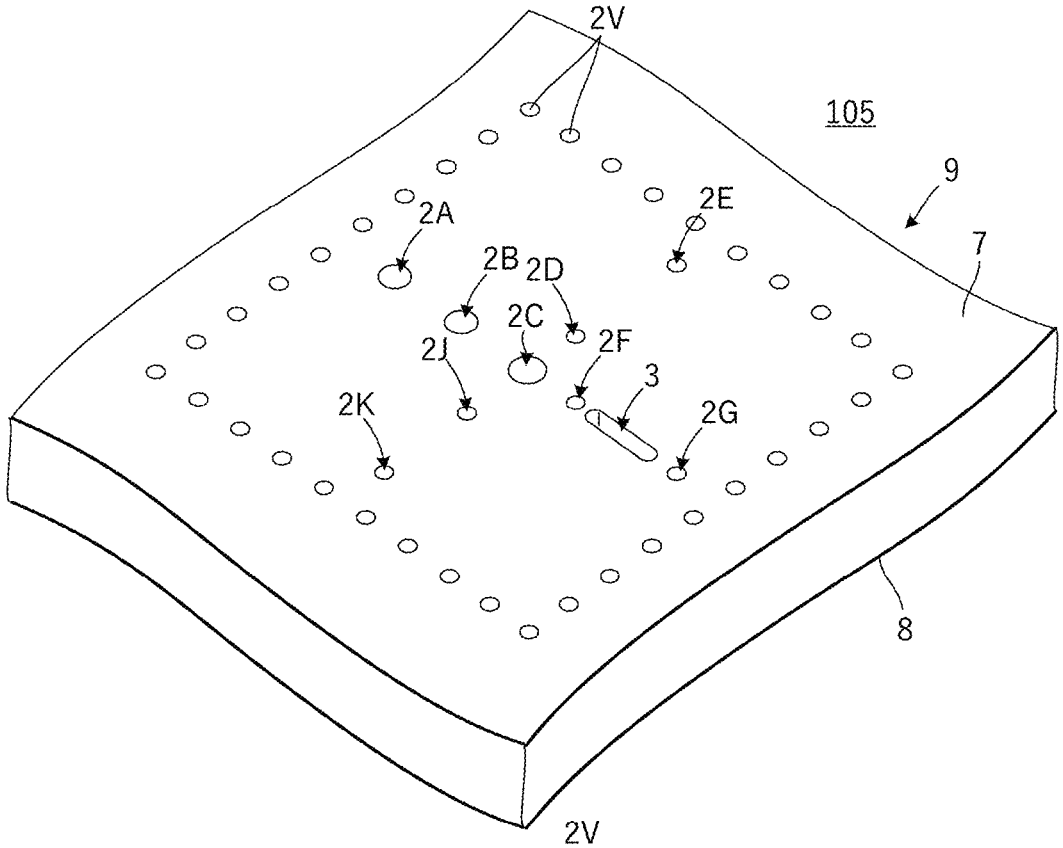
FIG. 18A is an external perspective view of a dielectric waveguide filter 105 according to a fifth preferred embodiment of the present invention and FIG. 18B is a transparent perspective view illustrating an internal structure of the dielectric waveguide filter 105.
Figure 18B:
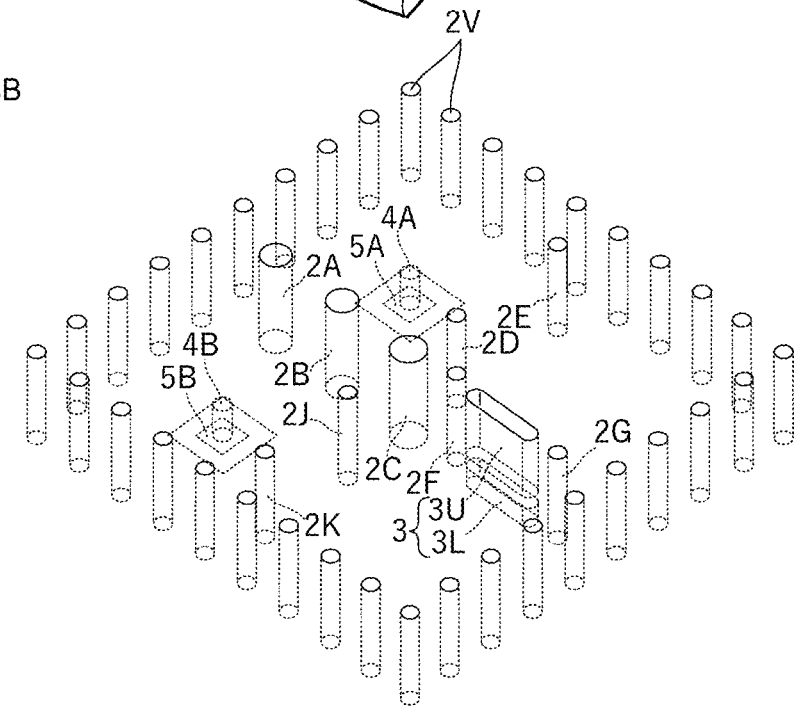

A fifth preferred embodiment of the present invention describes an example of a dielectric waveguide filter provided on a substrate. FIG. 18A is an external perspective view of a dielectric waveguide filter 105 according to the fifth preferred embodiment and FIG. 18B is a transparent perspective view illustrating an internal structure of the dielectric waveguide filter 105.

The dielectric waveguide filter 105 is structured in a dielectric block having a rectangular or substantially rectangular parallelepiped shape but is structured in a portion of a substrate 9. The substrate 9 includes a dielectric plate (insulator plate), a conductor film 7 on the upper surface of the dielectric plate, and a conductor film 8 on the lower surface of the dielectric plate. The substrate 9 is preferably a glass-epoxy (FR-4) substrate, for example.

In the present preferred embodiment, a plurality of penetrating posts (via conductors) 2V are arranged on positions corresponding to surfaces of outer side portions of the dielectric block 1 illustrated in FIG. 1A. Conductor films are provided on inner surfaces of these penetrating posts 2V and the conductor films conduct with the conductor films 7 and 8. With this structure, wall surfaces equivalent to the surfaces of the outer side portions of the dielectric block 1 are provided.

The internal structure surrounded by the penetrating posts 2V in FIGS. 18A and s18B is the same as or similar to the structure illustrated in FIGS. 1A and 1B.

Thus, a dielectric waveguide filter may be defined by, for example, a substrate integrated waveguide (SIW), a post-wall waveguide (PWW), and the like.

The adjacent interval among the penetrating posts 2V defining equivalent wall surfaces is in a relationship in which a cut off frequency of the penetrating posts 2V is higher than the pass band of the filter. This is achieved by setting the adjacent interval among the penetrating posts 2V as expressed below.

Formula 1

$$f_c = \frac{1}{2\pi}\frac{C_o}{\sqrt{\varepsilon_r}}\sqrt{\left(\frac{m\pi}{a}\right)^2+\left(\frac{n\pi}{b}\right)^2} \quad (1)$$

Where, $f_c$: cut off frequency, a: inter-hole interval of the penetrating posts 2V, b: interval between the upper and lower conductor films 7 and 8, $C_o$: light speed in vacuum, $\varepsilon_r$: relative permittivity of dielectric part (insulator part) of substrate, and m, n: orders of waveguide mode.

The cut off frequency is a scale for ease of passing of electromagnetic waves (waveguide mode: TE mode) and electromagnetic waves whose frequencies are equal to or lower than the cut off frequency are cut off and do not pass. Leakage of electromagnetic waves from gaps among the penetrating posts 2V causes an increase in loss, so that it is important to narrow intervals among the penetrating posts 2V and set the cut off frequency to a higher frequency than the pass band of the filter.

A fundamental mode (the TE10 mode of the lowest order) is generally used in a waveguide, so that the cut off frequency can be easily expressed as below by setting m=1 and n=0 in the above formula (1).

Formula 2

$$f_c = \frac{1}{2a}\frac{C_o}{\sqrt{\varepsilon_r}} \quad (2)$$

Further, as described above, the loss will increase unless the cut off frequency $f_c$ is at least higher than the center frequency f of the filter, so that the following is obtained.

Formula 3

$$f < f_c = \frac{1}{2a}\frac{C_o}{\sqrt{\varepsilon_r}} \quad (3)$$

$$a < \frac{1}{2}\frac{C_o}{\sqrt{\varepsilon_r}}\frac{1}{f}$$

For example, if the center frequency of the filter is increased, a cut off frequency has to be increased by the amount of the increase of the center frequency and the inter-hole interval of the penetrating posts 2V has to be narrowed.

Here, the penetrating post 2V may have a solid structure obtained by burying the inner surface with conductor. Further, the sectional shape of the penetrating post 2V does not have to be a circular or substantially circular shape, and may be an oval shape or a rounded corner rectangular or substantially rectangular shape. Further, the input/output structure is not limited to being provided at the lower surface or the upper surface of the substrate 9, and the input/output structure may be provided at an equivalent lateral wall including the plurality of penetrating posts 2V.

Sixth Preferred Embodiment

A sixth preferred embodiment of the present invention describes an example of a mobile phone base station to which a dielectric waveguide filter is applied.

Figure 19:
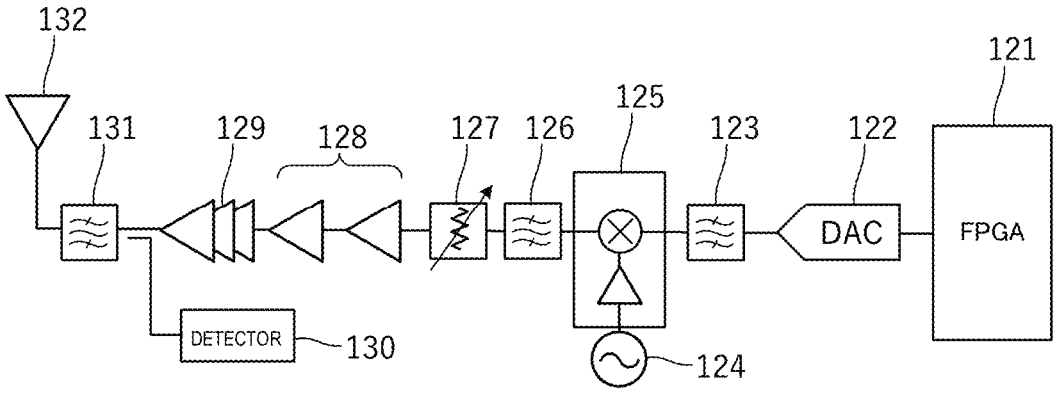
FIG. 19 is a block diagram of a mobile phone base station according to a sixth preferred embodiment of the present invention.

FIG. 19 is a block diagram of a mobile phone base station. A circuit of the mobile phone base station includes an FPGA 121, a DA converter 122, band pass filters 123, 126, and 131, a single mixer 125, a local oscillator 124, an attenuator 127, an amplifier 128, a power amplifier 129, a detector 130, and an antenna 132.

The FPGA 121 generates a modulated digital signal. The DA converter 122 converts the modulated digital signal into an analog signal. The band pass filter 123 allows a signal in a frequency band of a baseband to pass therethrough and removes signals of other frequency bands. The single mixer 125 mixes an output signal of the band pass filter 123 with an oscillation signal of the local oscillator 124, to perform up-conversion. The band pass filter 126 removes an unwanted frequency band generated through the up-conversion. The attenuator 127 adjusts strength of a transmission wave, and the amplifier 128 performs previous-stage amplification with respect to the transmission wave. The power amplifier 129 power-amplifies the transmission wave and transmits the transmission wave from the antenna 132 with the band pass filter 131 interposed therebetween. The band pass filter 131 allows a transmission wave in a transmission frequency band to pass therethrough. The detector 130 detects transmission power.

In such a mobile phone base station, the dielectric waveguide filter described in the first preferred embodiment to the fourth preferred embodiment can be used as the band pass filters 126 and 131 which allow a transmission wave in a transmission frequency band to pass therethrough.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A dielectric waveguide filter comprising:

at least four dielectric waveguide resonators arranged along a main coupling path for signal propagation; and a plurality of main coupling portions each of which is provided between dielectric waveguide resonators that are adjacent to each other along the main coupling path among the at least four dielectric waveguide resonators; wherein all of the plurality of main coupling portions along the main coupling path include only an inductive coupling portion and a capacitive coupling portion that are alternately arranged along the main coupling path.

2. The dielectric waveguide filter according to claim 1, wherein among the plurality of main coupling portions, a main coupling portion between a dielectric waveguide resonator of the at least four dielectric waveguide resonators that inputs/outputs a signal from/to an outside and a dielectric waveguide resonator of the at least four dielectric waveguide resonators that is coupled with the dielectric waveguide resonator performing the input/output is an inductive coupling portion.

3. The dielectric waveguide filter according to claim 1, wherein the plurality of dielectric waveguide resonators are arranged along a sub coupling path as well as the main coupling path for signal propagation; and the dielectric waveguide filter further includes one or more sub coupling portions each of which is provided between dielectric waveguide resonators of the at least four dielectric resonators, the dielectric waveguide resonators being adjacent to each other along the sub coupling path.

4. The dielectric waveguide filter according to claim 3, wherein among a plurality of coupling portions defining the main coupling portions and the sub coupling portions, a number of capacitive coupling portions is smaller than a number of inductive coupling portions.

5. The dielectric waveguide filter according to claim 3, wherein when four dielectric waveguide resonators that are sequentially coupled by the main coupling portions among the at least four dielectric waveguide resonators are referred to as a first dielectric waveguide resonator, a second dielectric waveguide resonator, a third dielectric waveguide resonator, and a fourth dielectric waveguide resonator in sequence, a main coupling portion between the first dielectric waveguide resonator and the second dielectric waveguide resonator is an inductive coupling portion, a main coupling portion between the second dielectric waveguide resonator and the third dielectric waveguide resonator is a capacitive coupling portion, and a main coupling portion between the third dielectric waveguide resonator and the fourth dielectric waveguide resonator is an inductive coupling portion; and among the one or more sub coupling portions, a sub coupling portion between the first dielectric waveguide resonator and the fourth dielectric waveguide resonator is an inductive coupling portion, and coupling of the sub coupling portion is weaker than coupling of the main coupling portions.

6. The dielectric waveguide filter according to claim 5, wherein the capacitive coupling portion of the main coupling portion and a capacitive coupling portion of the sub coupling portion are defined by a continuously-integrated common post that limits a width in an electric field direction of respective adjacent ones of the plurality of dielectric waveguide resonators.

7. The dielectric waveguide filter according to claim 6, wherein the continuously-integrated common post has a T shape or an L shape when viewed in the electric field direction.

8. The dielectric waveguide filter according to claim 5, wherein the capacitive coupling portion of the main coupling portion and the inductive coupling portion of the sub coupling portion are defined by an integrated common post including a portion limiting a width in an electric field direction of respective adjacent ones of the plurality of dielectric waveguide resonators and a portion limiting a width orthogonal or substantially orthogonal to the electric field direction of the respective adjacent ones of the plurality of the dielectric waveguide resonators.

9. The dielectric waveguide filter according to claim 8, wherein the integrated common post has a T shape or an L shape when viewed in the electric field direction.

10. The dielectric waveguide filter according to claim 5, wherein the inductive coupling portion of the main coupling portion and a capacitive coupling portion of the sub coupling portion are defined by an integrated common post including a portion limiting a width orthogonal or substantially orthogonal to an electric field direction of respective adjacent ones of the plurality of dielectric waveguide resonators and a portion limiting a width in the electric field direction of the respective adjacent ones of the plurality of the dielectric waveguide resonators.

11. The dielectric waveguide filter according to claim 10, wherein the integrated common post has a T shape or an L shape when viewed in the electric field direction.

12. The dielectric waveguide filter according to claim 5, wherein the inductive coupling portion of the main coupling portion and the inductive coupling portion of the sub coupling portion are defined by a continuously-integrated common post that limits a width orthogonal or substantially orthogonal to an electric field direction of respective adjacent ones of the plurality of dielectric waveguide resonators.

13. The dielectric waveguide filter according to claim 12, wherein the continuously-integrated common post has a T shape or an L shape when viewed in the electric field direction.

14. The dielectric waveguide filter according to claim 5, wherein a plurality of groups of the four dielectric waveguide resonators are provided, and the main coupling portion is between the fourth dielectric waveguide resonator on a previous stage group of the plurality of groups and the first dielectric waveguide resonator on a subsequent stage group of the plurality of groups continuous with the previous stage group; and among the one or more sub coupling portions, a sub coupling portion is between the third dielectric waveguide resonator on the previous stage group and the second dielectric waveguide resonator on the subsequent stage group.

15. The dielectric waveguide filter according to claim 14, wherein the inductive coupling portion of the main coupling portion and the inductive coupling portion of the sub coupling portion are defined by a continuously-integrated common post that limits a width orthogonal or substantially orthogonal to an electric field direction of respective adjacent ones of the plurality of dielectric waveguide resonators.

16. The dielectric waveguide filter according to claim 15, wherein the continuously-integrated common post has a T shape or an L shape when viewed in the electric field direction.

17. The dielectric waveguide filter according to claim 14, wherein the capacitive coupling portion of the main coupling portion and a capacitive coupling portion of the sub coupling portion are defined by a continuously-integrated common post that limits a width in an electric field direction of respective adjacent ones of the plurality of dielectric waveguide resonators.

18. The dielectric waveguide filter according to claim 17, wherein the continuously-integrated common post has a T shape or an L shape when viewed in the electric field direction.

19. The dielectric waveguide filter according to claim 14, wherein the capacitive coupling portion of the main coupling portion and the inductive coupling portion of the sub coupling portion are defined by an integrated common post including a portion limiting a width in an electric field direction of respective adjacent ones of the plurality of dielectric waveguide resonators and a portion limiting a width orthogonal or substantially orthogonal to the electric field direction of the respective adjacent ones of the plurality of dielectric waveguide resonators.

20. The dielectric waveguide filter according to claim 14, wherein the inductive coupling portion of the main coupling portion and a capacitive coupling portion of the sub coupling portion are defined by an integrated common post including a portion limiting a width orthogonal or substantially orthogonal to an electric field direction of respective adjacent ones of the plurality of dielectric waveguide resonators and a portion limiting a width in the electric field direction of the respective adjacent ones of the plurality of dielectric waveguide resonators.

* * * * *